United States Patent [19]

Rapp

[11] Patent Number: 4,811,770

[45] Date of Patent: Mar. 14, 1989

[54] STRUCTURAL ELEMENT FOR A BUILDING

[76] Inventor: Albert B. Rapp, Pater-Kilian-Str 3, D-5983 Balve 1, Fed. Rep. of Germany

[21] Appl. No.: 30,729

[22] Filed: Mar. 25, 1987

[30] Foreign Application Priority Data

Mar. 25, 1986 [DE] Fed. Rep. of Germany ..... 3610030

[51] Int. Cl.[4] ..... E04C 1/00

[52] U.S. Cl. ..... 52/309.12; 52/332; 52/337; 52/453

[58] Field of Search ..... 52/309.12, 327, 331, 52/332, 324, 337, 453

[56] References Cited

U.S. PATENT DOCUMENTS

| | | | |
|---|---|---|---|
| 1,006,424 | 10/1911 | Asher | 52/324 X |
| 1,702,706 | 2/1929 | Schuster | 52/324 X |
| 2,154,390 | 4/1939 | Akers | 52/337 X |
| 4,625,484 | 12/1986 | Oboler | 52/309.12 X |
| 4,706,429 | 11/1987 | Young | 52/309.12 |

FOREIGN PATENT DOCUMENTS

| | | | |
|---|---|---|---|
| 545 | 1/1899 | Austria | 52/453 |
| 55530 | 11/1938 | Denmark | 52/324 |
| 510264 | 9/1920 | France | 52/324 |
| 517090 | 4/1921 | France | 52/324 |
| 1175492 | 11/1958 | France | 52/337 |
| 2240325 | 3/1975 | France | 52/309.12 |
| 2449175 | 10/1980 | France | 52/320 |

*Primary Examiner*—John E. Murtagh
*Assistant Examiner*—Andrew Joseph Rudy
*Attorney, Agent, or Firm*—Herbert Dubno

[57] ABSTRACT

The structural element for a building comprises an insulating panel and a concrete rib plate. The concrete rib plate has a plurality of base members and rib members and is cast on the insulating panel used instead of a form. The rib members are fastened in corresponding recesses of the insulating panel. The concrete rib plate has a planar reinforcement in the form of at least one steel mat and the rib members have corresponding rib reinforcing elements. The insulating panel is provided with a plurality of spacing retainers in the recesses and in the base members on which the steel mat and the rib reinforcing elements rest and which position and orient the steel mat and the rib reinforcing elements.

6 Claims, 2 Drawing Sheets

STRUCTURAL ELEMENT FOR A BUILDING

FIELD OF THE INVENTION

My present invention relates to a structural element for a building and, more particularly, to a slab structure consisting of a concrete slab bonded to an insulating slab.

BACKGROUND OF THE INVENTION

A composite structural element in the form of a slab for a building is known comprising an insulating panel and a concrete rib plate.

The concrete rib pate with its base members and rib members is cast on the insulating panel instead of on a form which is removed.

The concrete rib plate has rib members which fit into corresponding recesses of the insulating panel. Further the concrete rib plate can have a planar reinforcement in the form of a steel mat and rib reinforcing elements (e.g. baskets) of reinforcing bar (rebar) for the rib members.

The structural element of my invention can be either a wall or a floor element. This structural element is designed to be sound and/or heat insulating. The insulating panel is intended to take the place of the removable form and thus become a so-called "lost form" in the manufacture of the structural element to allow simple manufacture of the structural element.

Moreover, the insulating panel used as a form can be combined with a form side wall composed of another material, for example wood. The insulating panel can fulfill additional functions in the structural element according to my invention. In fact it can be a multifunctional insulating panel having embedded electrical insulation, communication elements, and heat and water facilities.

A structural element found satisfactory in practice is described in German Patent Application No. P 21 15 250.1-09. It has however been required for automatic mass production to provide the steel mat at least with spacing retainers and rib reinforcing elements correspondingly equipped with spacing retainers installed and distributed in the form to provide a reinforcing cage. The individual mounting of the spacing retainers and the exact installation of the reinforcing components is time consuming, expensive, and interferes with the automatic mass production.

OBJECTS OF THE INVENTION

It is an object of my invention to provide an improved structural element for a building which obviates the above-mentioned drawbacks.

It is also an object of my invention to provide an improved structural element for a building which can be mass produced in a simple way.

It is another object of my invention to provide an improved structural element for a building which can be part of a wall or a floor and can be used for sound and/or thermal insulation and can be mass produced in a simple way.

SUMMARY OF THE INVENTION

These objects and others which will become more readily apparent hereinafter are attained in accordance with my invention in a structural element for a building comprising an insulating panel or slab and a concrete rib plate or slab. The concrete rib plate has a plurality of base members and rib members cast in one piece on the insulating panel instead of on a removable form.

The rib members are engaged in corresponding recesses of the insulating panel. The concrete rib plate has a planar reinforcement in the form of at least one steel mat and the rib members have corresponding rib reinforcing elements.

According to my invention the insulating panel is provided unitarily and integrally with a plurality of spacing retainers in the recesses and in the base members on which the steel mat and the rib reinforcing elements rest and which position and orient the steel mat and the rib reinforcing elements.

Preferably the spacing retainers are molded on the insulating panel. However, they can also be glued on or otherwise attached in a less desirable mode of practicing the invention.

Most advantageously, the spacing retainers are components of the insulating panel formed unitarily therewith when the structural element of my invention is manufactured.

In the example in which the steel mat comprising a plurality of longitudinal and transverse rods has a predetermined grid size the invention teaches that the spacing retainers should have a plurality of positioning receptacles for the longitudinal and transverse rods positioned according to the grid size.

It is of particular significance and advantage, according to a feature of my invention that the rib reinforcing elements for the rib members are not all part of a reinforcing cage or basket. This embodiment is characterized by the recesses corresponding to the rib members having spacing retainers with positioning receptacles in which unattached reinforcing rods not forming part of the cage are inserted according to the planes of the rib reinforcing elements. It is of course possible to provide the rib reinforcing elements in the form of a reinforcing cage. In that case the reinforcing cages can act additionally as spacing retainers for the steel mat.

Thus my invention uses the principle that an insulating panel can fulfill an additional function, namely the orientation and positioning of the reinforcing components by the spacing retainers which can be part of the insulating panel and which can be easily provided during manufacture.

Particularly when the insulating panel is composed of foamed plastic (synthetic resin) material the spacing retainers can be easily molded on or glued in place. The insulating panel is made in a suitable form. The spacing retainers may be continuously arranged so that the static assembly is not disturbed, no matter whether the structural element is used as a wall element or a floor element. The insulating panel can be assembled from several parts.

The invention also is a novel method of making a structural element for a building, which comprises the steps of:

(a) molding an insulating slab of a foamed synthetic resin material integrally and unitarily with a planar surface on one side of the slab and a plurality of ribs alternating with recesses on an opposite side of the slab, the ribs having flat faces parallel to the planar surface and the recesses having flat floors parallel to the planar surface, and with spacer formations projecting from at least some of the flat faces and the floors;

(b) placing on the spacers an openwork concrete reinforcement structure consisting at least in part of reinforcing bars so that the structure is supported substantially exclusively on the spacer formations unitary with the insulating slab; and (c) casting concrete into and around the openwork concrete reinforcement structure to form a concrete slab secured to the insulating slab and in which the reinforcement structure is embedded to a depth from the faces and the floors determined by the heights of the spacer formations.

Advantageously baskets of the reinforcing bars constituting part of the structure are placed upon the spacer formations rising from the floors to reinforce ribs formed on the concrete slab.

In this case the method can further comprise the step of supporting at least one mat forming part of the concrete structure on the baskets.

Alternatively at least one concrete mat forming part of the structure is supported on the spacer formations rising from the faces.

BRIEF DESCRIPTION OF THE DRAWING

The above and other objects, features and advantages of my invention will become more readily apparent from the following specific description, reference being made to the accompanying highly diagrammatic drawing in which.

SPECIFIC DESCRIPTION

Figure 1:
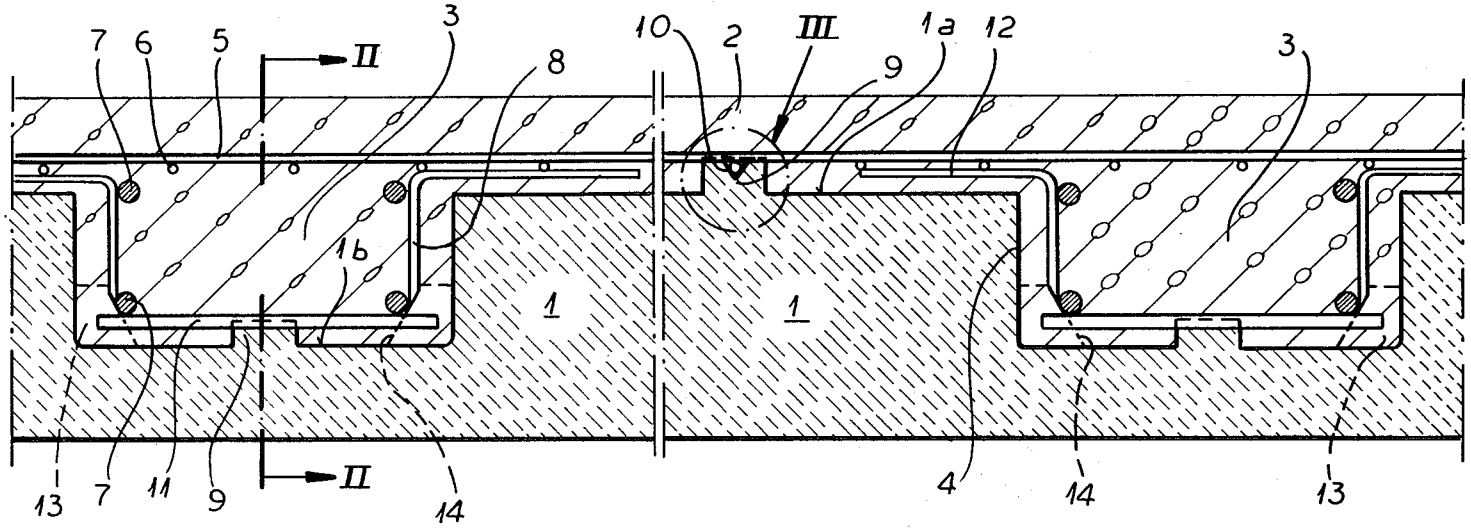
FIG. 1 is a longitudinal cross sectional view of a structural element of a building according to my invention.
Figure 2:
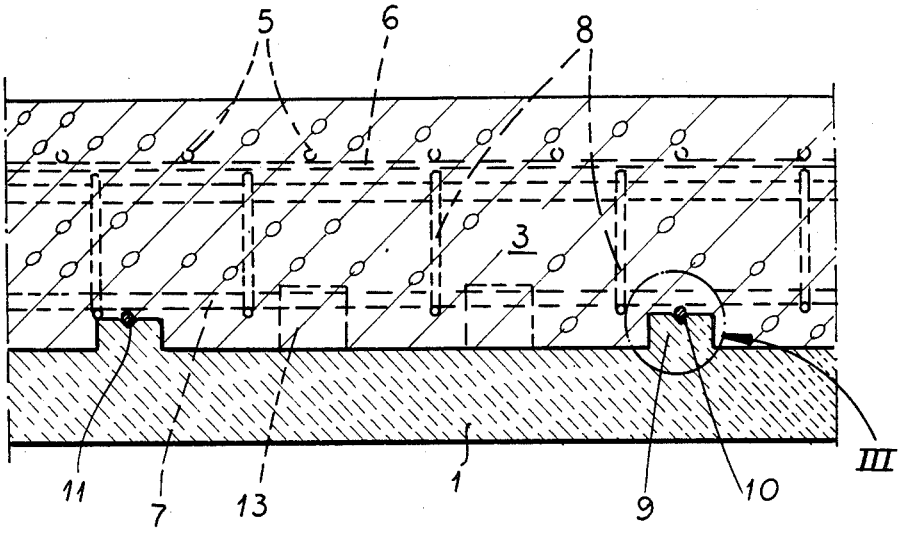
FIG. 2 is a cross sectional view through the structural element taken along the sectional line II—II of FIG. 1.
Figure 3:
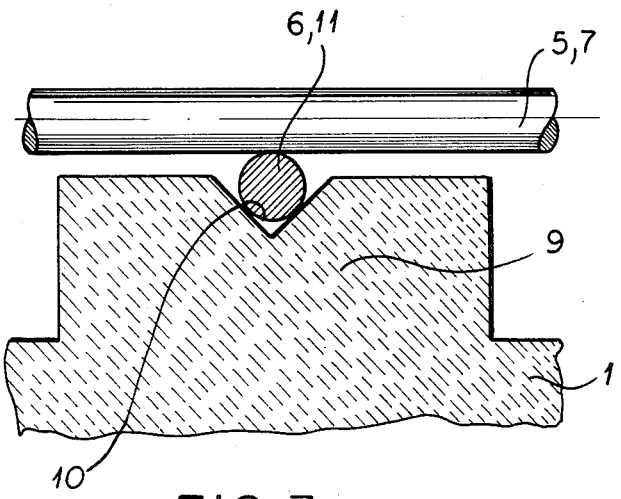
FIG. 3 is an enlarged cross sectional view of the circled portions III of FIGS. 1 and 2.

The structural element shown in the drawing is designed for a building. It comprises an insulating panel 1 and a steel-reinforced concrete rib plate 2, 3.

The steel-reinforced concrete rib plate is cast with its base members 2 and rib members 3 on the insulating panel instead of the missing form.

The structure is such that the rib members 3 engage in the corresponding recesses 4 of the insulating panel 1.

The steel-reinforced concrete rib plate 2, 3 is provided with a steel reinforcement in the form of a steel mat 5, 6.

The steel mat 5, 6 comprises usually a plurality of longitudinal rods 5 and transverse rods 6 of rebar.

The rib members 3 have a rib reinforcing elements 7, 8. These rib reinforcing elements comprise a plurality of rib reinforcing rods 7 running in the rib longitudinal direction and these are attached spaced from each other by tie rods 8.

The insulating panel 1 is provided with integral and unitary spacing retainers 9 in the recess 4 and in the base member 2.

The steel mat 5, 6 and the rib reinforcing elements 7, 8 are located on these spacing retainers 9.

Both the steel mat 5, 6 and also the rib reinforcing elements 7, 8 are positioned above the spacing retainers 9.

The spacing retainers 9 are molded in the insulating panel at the time it is made and project from the rib faces 1*a* and the recess bottoms 1*b*.

The steel mat comprise a plurality of longitudinal rods 5 and/or transverse rods 6 forming a grid of a predetermined grid size so the spacing retainers 9 for the longitudinal rods 5 and/or the transverse rods 6 are provided with positioning receptacles 10 according to the grid size of the steel mat.

In this arrangement the recesses 4 corresponding to rib members 3 are provided with spacing retainers 9 which likewise have positioning receptacles 10. In these receptacles 10 unattached reinforcing rods 11 are inserted according to the plane of the rib reinforcement. The rib reinforcing rods 7 running in the longitudinal direction of the rib members 3 can then be supported on them.

The rib reinforcing elements 7, 8 can be formed as a reinforcing cage so additional spacing retainers 9 can be provided for the steel mat 5, 6. The tie rods 12 are bent away toward the exterior in the direction of the base members 2.

The reinforcing cage comprising the rib reinforcing rods 7 and the tie rods 8 thus undergoes a definite orientation by the steel mat 5, 6 together with the spacing retainers 9 located in the base members 2.

To arrange the reinforcing cage comprising the rib reinforcing elements 7 and the tie rods 8 centrally in the recesses 4 additional spacing members 13 are provided. The spacing members 13 receive the rib reinforcing rods 7 running in the longitudinal direction of the rib members 3 in the lower part of the reinforcement cage between themselves and are provided with inclined guiding surfaces 14.

In practice it frequently is desirable to make structural members in the space of wall or deck plates which are equipped for different grid sizes. Within the ambit of my invention the insulating panel 1 is assembled from parts which themselves provide for different grid sizes in which the separating lines are located in the vicinity of rib members.

I claim:

1. In a structural element for a building comprising an insulating panel and a concrete rib plate, said concrete rib plate having a plurality of base members and rib members being cast on said insulating panel instead of a form, each of said rib members being engaged in corresponding recesses of said insulating panel, said concrete rib plate having a planar reinforcement in the form of at least one steel mat and said rib members having a corresponding plurality of rib reinforcing elements, the improvement wherein said insulating panel is provided with a plurality of spacing retainers some of which project into said rib members and some into said base members on which said steel mat and said rib reinforcing elements rest and which position and orient said steel mat and said rib reinforcing elements, said steel mat having a plurality of longitudinal rods and transverse rods with a predetermined grid size, said spacing retainers for said rods of said steel mat having a plurality of positioning receptacles according to said grid size, and said receptacles being sunken areas cut into said retainers sufficiently large for holding said rods against movement.

2. The improvement according to claim 1 wherein said spacing retainers are molded on said insulating panel.

3. The improvement according to claim 1 wherein said longitudinal rods and said transverse rods are each positioned in a plurality of said positioning receptacles.

4. The improvement according to claim 4 wherein said recesses for said rib members having said spacing retainers with said positioning receptacles and in said positioning receptacles a plurality of unattached noncage reinforcing rods are inserted according to the plane of said rib reinforcing elements.

5. The improvement according to claim 1 wherein said rib reinforcing elements provide a reinforcing cage in each of said rib members and said reinforcing cages provide said spacing retainers for said steel mat.

6. A structural element for a building comprising:

an insulating panel having a plurality of recesses;

a concrete rib plate having a plurality of base members and rib members being cast on said insulating panel instead of a form, each of said rib members being engaged in one of said recesses of said insulating panel;

a planar reinforcement for said concrete rib plate in the form of at least one steel mat comprising a plurality of a longitudinal rods and transverse rods with a predetermined grid size;

a plurality of rib reinforcing elements located within said rib members; and a plurality of spacing retainers having a plurality of positioning receptacles according to said grid size, some of said spacing retainers projecting from said insulating panel into said rib members and some into said base members on which said steel mat and said rib reinforcing elements rest and which position and orient said steel mat and said rib reinforcing elements, said receptacles being sunken areas cut into said retainers sufficiently large for holding said rods against movement.

* * * * *